United States Patent [19]

Jay

[11] 3,946,876

[45] Mar. 30, 1976

[54] HINGED POST STORAGE RACK

[75] Inventor: Richard S. Jay, Evanston, Ill.

[73] Assignee: Jarke Corporation, Chicago, Ill.

[22] Filed: Mar. 18, 1974

[21] Appl. No.: 451,801

[52] U.S. Cl. ..... 211/60 R; 108/55; 220/1.5

[51] Int. Cl.[2] ..... B65D 19/44

[58] Field of Search ..... 108/53, 55, 56, 51, 57, 108/58; 211/60, 148, 177, 41; 214/10.5 R; 220/1.5, 97 R; 248/188.4, .5, 188.6

[56] References Cited

UNITED STATES PATENTS

| | | | |
|---|---|---|---|
| 2,699,911 | 1/1955 | Chase et al. | 211/148 |
| 2,863,566 | 12/1958 | White et al. | 211/41 |
| 2,956,763 | 10/1960 | D'Arca | 108/53 |
| 2,998,141 | 8/1961 | Moore et al. | 211/41 |
| 3,499,398 | 3/1970 | Murray | 108/53 |
| 3,565,018 | 2/1971 | Jay | 108/53 |
| 3,804,033 | 4/1974 | Izawa et al. | 108/55 |
| 3,807,581 | 4/1974 | Nichols | 108/53 X |

*Primary Examiner*—Roy D. Frazier
*Assistant Examiner*—Terrell P. Lewis
*Attorney, Agent, or Firm*—Dominik, Knechtel, Godula & Demeur

[57] ABSTRACT

A storage rack is disclosed and formed by a base; a pair of rear support tubular members mounted on the base and extending upwardly therefrom, a pair of front support tubular members mounted on the base and extending upwardly therefrom and in opposed relation with respect to the rear support tubular members, each of the front support tubular members being vertically shorter than the corresponding rear support tubular members, and each of the front support tubular members provided with an extension member hingedly mounted thereon for accommodating arcuate and pivotal movement of the extension member with respect to the front support tubular member, each extension member including a collar mounted on the lower end thereof and having an overall diameter slightly less than the diameter of the corresponding front support tubular member thereby to be positionable within the open confines of said front support tubular member and functioning to axially align and stabilize the extension member when vertically mounted on the front support tubular member.

6 Claims, 9 Drawing Figures

HINGED POST STORAGE RACK

BACKGROUND OF INVENTION

The provision of a variety of storage racks to accomplish specific purposes is a well-developed art. Generally, the overall goal is to maximize storage space while at the same time minimizing usable warehouse space, or in other words, to achieve compactness while at the same time permitting the storage of the greatest number of articles per unit of warehouse space. In many cases, the provision of modularized racks has been deemed to be an improvement in this art field, since modularized racks permit the user the widest latitude possible in terms of the utilization of warehouse space for the desired number of articles. Other types of improved racks permit the vertical stacking of one rack atop the other in order to achieve full utilization of the vertical height of the warehouse space.

With respect to the types of racks utilized for storing articles in a horizontal posture between front and rear supports, several problems are encountered. For example, if a plurality of such racks is employed in a vertical orientation, the user is bounded either by the height of the warehouse space, or the height to which a fork lift truck or other unloading device extends to its ultimate vertical reach. It is therefore been deemed desirable to develop a storage rack which permits for the front loading and unloading of items stored in horizontal alignment while still permitting the maximum utilization of vertical height in warehouse space.

To this end, storage racks having telescopically oriented and coupled sections have been provided whereby the front support posts are telescopically oriented along the vertical axis to permit sequential reduction of height from the front portion of the storage rack and hence permit the front loadng and unloading of articles stored therein. However, when such types of racks are dismantled, storage of these units is rendered difficult. In addition, from a manufacturing and economics standpoint, such types of racks employing telescopic oriented segments generally require a number of parts which are progressively decreasing in diameter, and hence, not of uniform configuration overall.

It is therefore deemed desirable to provide a storage rack which permits full and complete utilization of vertical storage space while at the same time permitting the front loading and unloading of articles stored therein and utilizing relatively standard sized parts. In addition, it is deemed desirable to formulate such storage racks such that the problem of elevating articles over the top of the rack to effect the loading and unloading operation is obviated, whereby the equipment utilized in the loading and unloading operations need not be extended to its ultimate vertical reach. The minimizing or obviating of this problem thereby permits the maximum utilization of vertical storage space while at the same time simplifying the loading and unloading operation.

OBJECTS AND ADVANTAGES

The principal object of the invention is to provide a storage rack formed by a segmented post assembly at the front portion thereof thereby permitting full utilization of vertical storage while at the same time obviating the need for elevating articles over the top of the rack during the loading and unloading operation.

In connection with the foregoing object, it is yet a further object of this invention to provide a storage rack formed of a front segmented post assembly wherein the movable segment is pivotally hinged to a lower section and further including a lock means for lockingly engaging the said segmented member in vertical alignment with the adjacent lower segment.

Yet a further object of this invention is to provide a storage rack having a vertically oriented storage well formed by a base, at least a pair of rear support members upstanding from the base, at least a pair of front support members upstanding from the base and in directly opposed relation with respect to the rear support members, the front support members being of a shorter height than the rear support members, each of the front support members including an extension member, hinge means interconnecting said front support member and the extension member in arcuately pivoting relation such that each extension member is permitted to travel through an arc of approximately 180° with respect to the front support member and lock means for lockingly engaging the extension member in vertical alignment with respect to the front support member.

In connection with the foregoing object, it is yet a further object of this invention to provide a storage rack of the type described, wherein at least the front support members and the extension member are each of tubular construction and the lock means comprises a collar extending downwardly from the lower portion of the extension member and having a diameter slightly less than the interior diameter of the corresponding front support member such that the collar is nestable within the confines of the upper portion of the front support member, thereby to axially align and stabilize the extension member when pivoted and locked into the use position.

Still in connection with the foregoing objects, it is yet a further object of this invention to provide a storage rack of the type described wherein the hinge means comprises of a pair of side plates mounted on each of the extension in opposed relation, the front support member provided with an arch plate confining a horizontal pivot pin for movement therein and wherein the outer extremities of the horizontal pivot pin are mounted on the opposed side plates of the extension member such that the extension member is pivotally and arcuately interconnected with respect to the corresponding front support member.

A further object of this invention is to be provide a storage rack of the type described above, wherein the hinge means may be modified to the extent that the opposed side plates are provided with vertical slots, and each of the front support members is provided with a horizontally mounted pivot pin having the outer extremities of the pivot pin carried within the opposed slots of opposed side plates on the extension member such that the extension member moves relative to the front support member with the horizontal pivot pin held in fixed and secured relation with respect to the front support member.

Another object of this invention is to provide a still further modified embodiment of a segmented post assembly wherein the extension member includes a collar mounted thereon and extending outwardly from the lower portion thereof and having a diameter slightly less than the interior diameter of a corresponding front support member, and the hinge means is formed by a hook member having one end thereof mounted on the extension member interiorly thereof and the opposed end carried within the confines of the front support member, the front support member carrying a stop boss interiorly thereof for limiting the travel of the opposed end of the hook whereby the extension member may be moved in an arcuate path throughout 180° with respect to the front support member while the hook retains the extension member in pivoted relation with respect to the front support member.

Further features of the invention pertain to the particular arrangement of the parts and the operating features whereby the above objects and advantages are attained.

These, and other features of the invention will best be understood by reference to the following specification taken in connection with the following drawings, in which.

Figure 9:
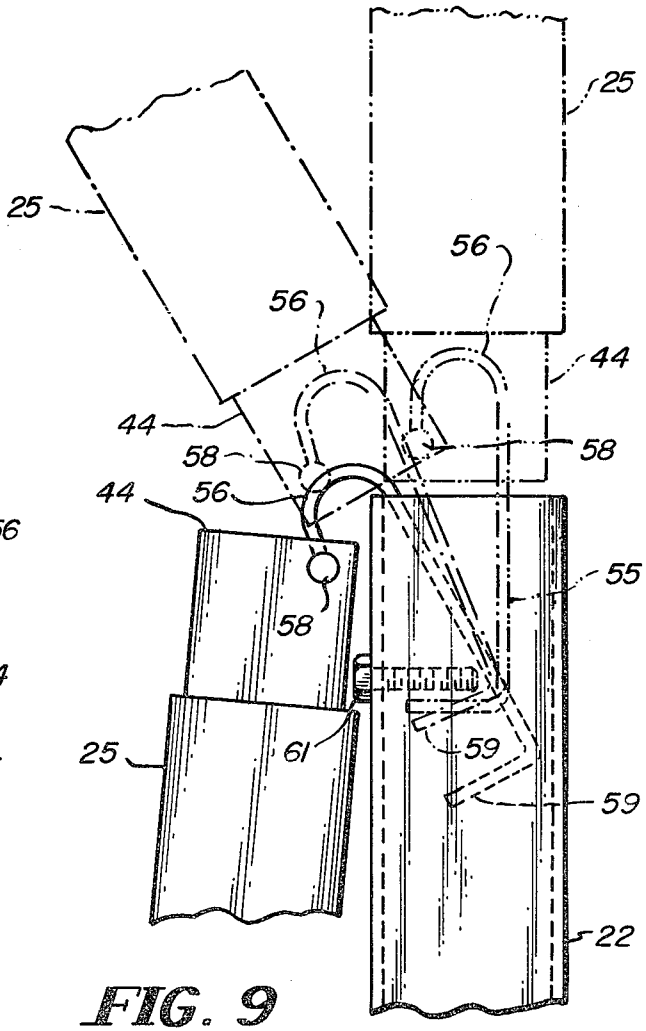
Figure 8:
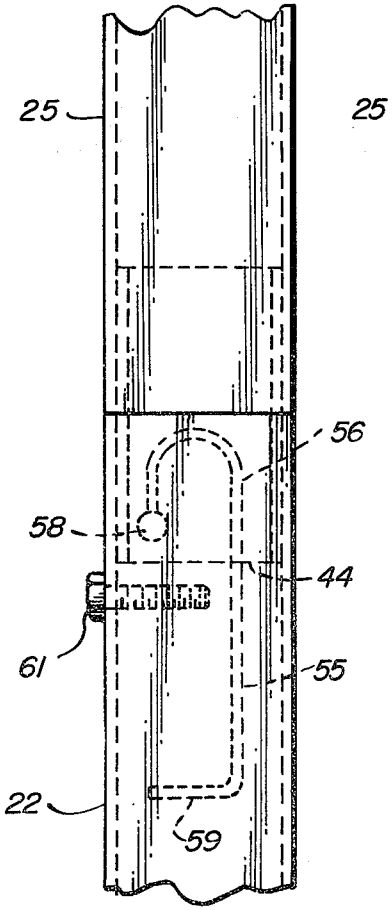

FIG. 8 is a side elevational view, partly in cross-section, of the joint portion of a post assembly, showing still another modified embodiment of the present invention wherein the hinge assembly consists of a hook interconnected between the extension member and the front support member; and FIG. 9 is a side elevational view, partly in phantom, illustrating the pivotal and arcuate movement of the extension member with respect to the front support member of the embodiment of the invention employing a concealed hook member as the hinge means.

DETAILED DESCRIPTION OF DRAWINGS

Figure 1:
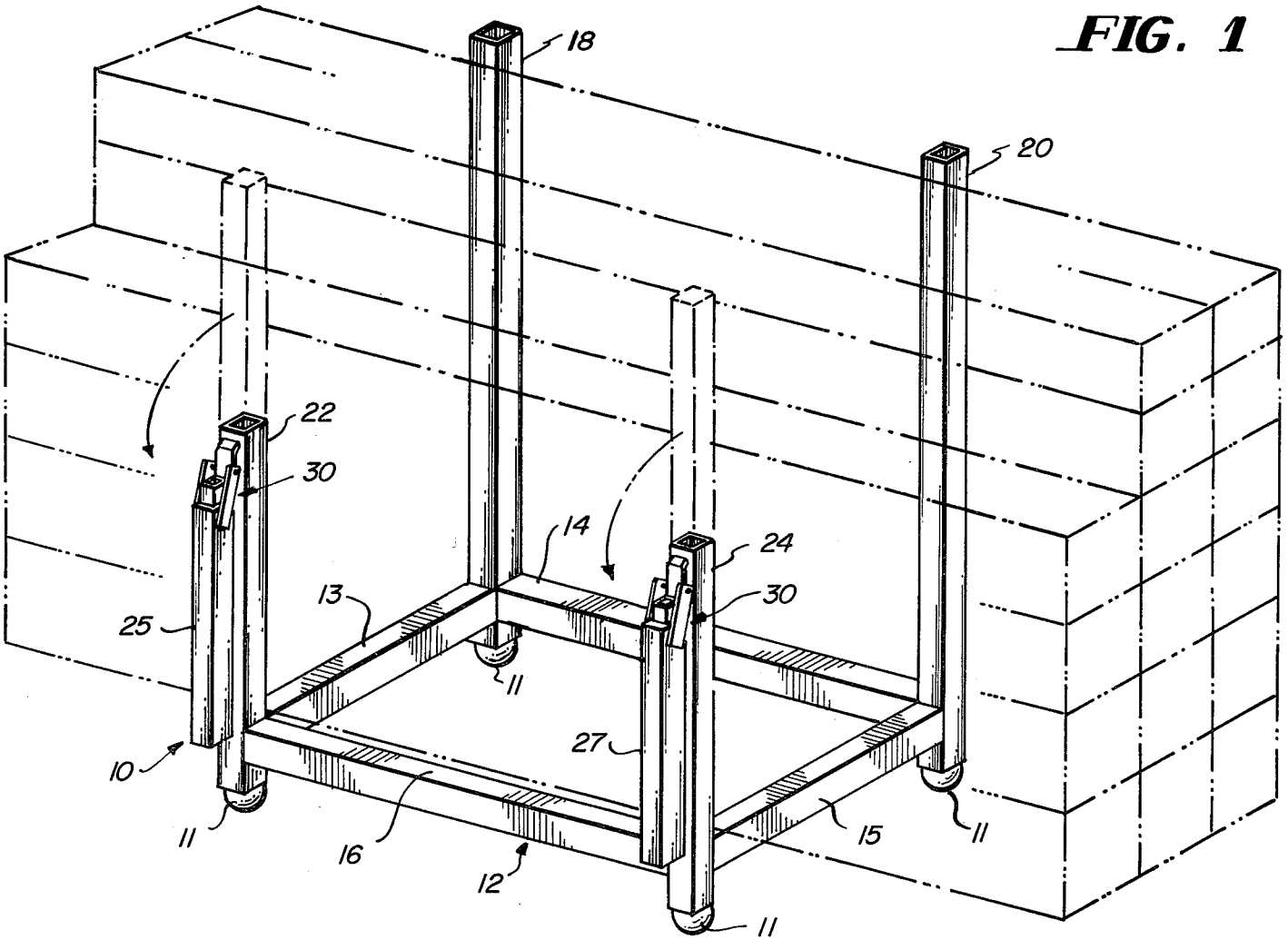
FIG. 1 is a perspective view showing a storage rack of the present invention, having articles stored horizontally therein in vertical orientation and wherein the segmented extension portion is shown in both the open and closed position.

With specific reference to FIG. 1 of the drawings, the storage rack, generally referred to by the numeral 10 is illustrated with a plurality of articles stored horizontally in vertical orientation. The storage rack 10 includes a base 12 formed by a series of four cross braces, 13, 14, 15 and 16, respectively. The storage rack 10 further includes a pair of rear support members 18 and 20 respectively, each of the rear support members 18 and 20 being tubular and having a square cross section. Positioned in directly opposed relation with respect to the corresponding rear support members 18 and 20 respective, are front support members 22 and 24 respectively. It will be observed that each of the front support members 22 and 24 are shorter in vertical height than the corresponding rear support members 18 and 20 respectively and each is further tubular in construction and square in cross section. Furthermore, each of the front support members 22 and 24 respectively are provided with an extension member 25 and 27 respectively, the extension members 25 and 27 being hingedly secured to the corresponding front support members 22 and 24 by means of a hinge assembly 30. The storage rack as depicted in FIG. 1 is completed by means of a plurality of tube inserts 11, which may be utilized to vertically stack one rack atop the other rack, the tubular inserts 11 being sized to nest within the open portion of the front and rear support members respectively.

With respect to FIGS. 2 through 5 of the drawings, the details of construction of the hinge assembly 30 are illustrated. While reference will be made to the extension member 25 in conjunction with the front support member 22, it will be understood that each of the front support members and extension members are provided with identical structures. It will be observed that the extension member 24 is provided with a pair of side plates 32 and 34 respectively, mounted thereon by weldments 35, the side plates 32 and 34 being angularly mounted as more clearly shown in FIG. 3 of the drawings. The angular mounting of the side plates 32 and 34 thereby provide an offset portion 36 which function for a purpose which will be more fully defined hereinafter.

The front support member 22 is provided with an arch plate 38 mounted at the top and bottom portions thereof by weldments 39. The construction of the arch plate 38 is such as to provide a confinement channel 40 which permits the riding movement of the pivot pin 42 along the vertical length thereof. The pivot pin 42 is mounted between the opposed side plates 32 and 34 respectively and rides within the confinement channel 40 of the arch plate 48.

The extension member 25 is further provided with a tubular collar 44 which has an overall exterior diameter slightly smaller than the interior diameter of the corresponding front support member 22. In this manner, the tubular collar 44 is nestable within the confines of the front support member 22, thereby to both vertically align and stabilize the extension member 25 when positioned in vertical alignment atop the front support member 22.

It now becomes apparent that by providing angularly mounted side plates 32 and 34 respectively, which include an offset portion 36, and wherein the offset portion 36 of the two side plates 32 and 34 carry the pivot pin 42 which simultaneously rides within the confinement channel 40 of the arch plate 38 both pivotal and arcuate movement of the extension member 25 with respect to the front support member 22 is accomplished.

Figure 5:
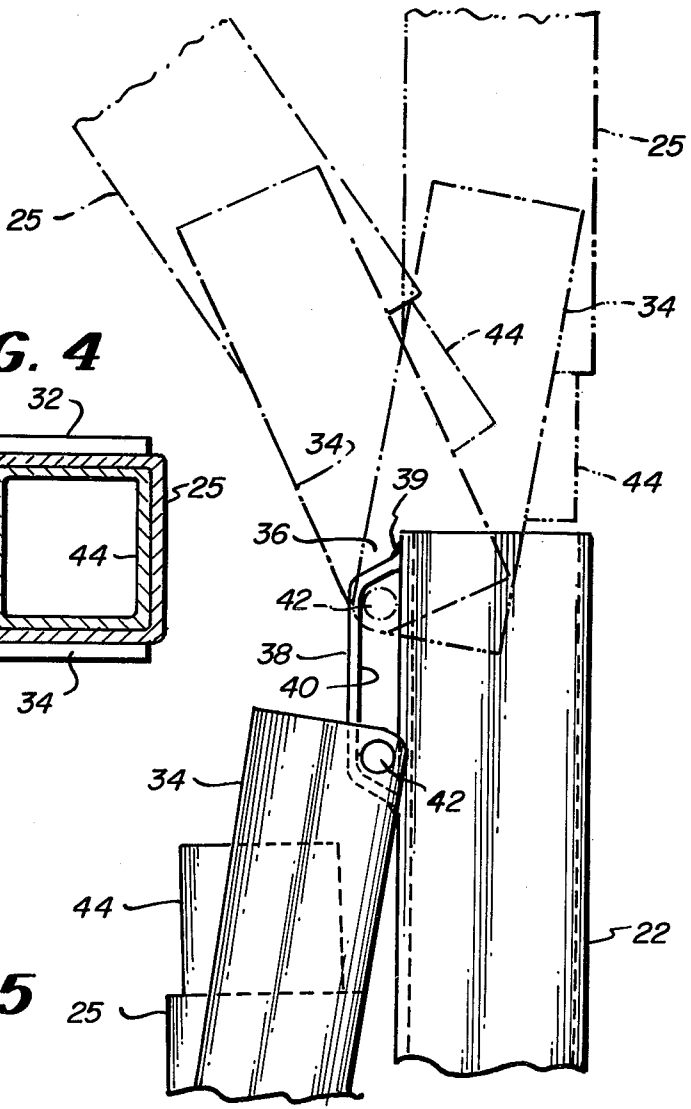
FIG. 5 is a side elevational view, partly in phantom, showing the path of travel of the extension member depicted in FIGS. 2, 3 and 4 of the drawings, as well as the manner in which locking engagement of the extension member with respect to the front support member is achieved.
Figure 4:
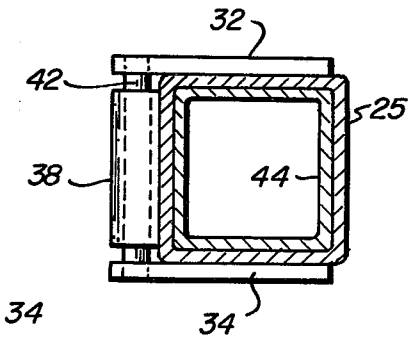
FIG. 4 is a top view of the extension member in mounting relationship with respect to the front support member taken in the direction of the arrows along the line 4—4 of FIG. 3.
Figure 3:
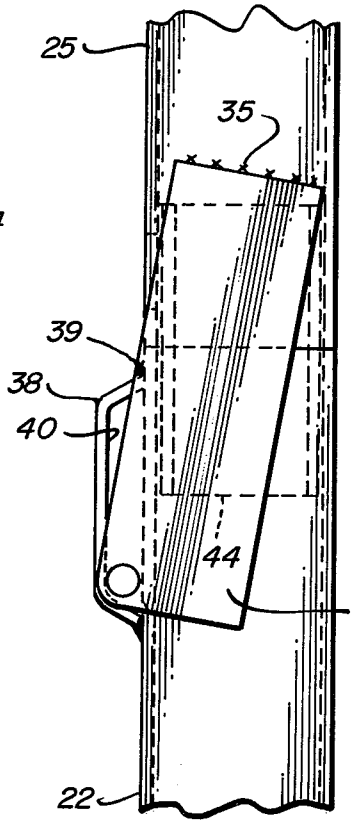
FIG. 3 is a side elevational view, partly in cross section, of the joint portion of a post assembly, showing the extension member in mounting relationship with respect to the front support member and illustrating one embodiment of the hinge assembly provided by this invention.
Figure 2:
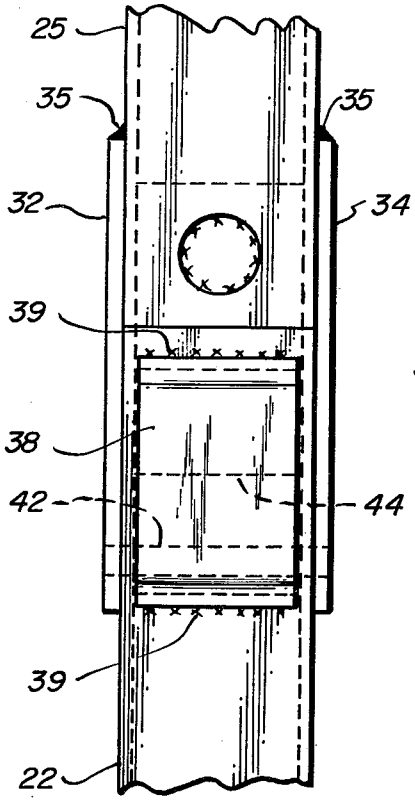
FIG. 2 is a front elevational view, partly in cross section of the joint portion of a post assembly, showing the extension member mounted on and in vertical alignment with the front support member.

With reference to FIG. 5 of the drawings, the movement of the extension member 25 with respect to the front support member 22 is illustrated. It will be observed that by providing the free movement of the pivot pin 42 within the confinement channel 40 of the arch plate 38, and along the vertical length thereof, the free pivotal and arcuate movement of the extension member 25 into the vertically and axially aligned position with respect to the front support member 22 is accomplished. In addition, the provision of the tubular collar 44 provides a convenient locking means as well as a means for vertically aligning the extension member 25 with respect to the front support member 22 is further accommodated.

Figure 7:
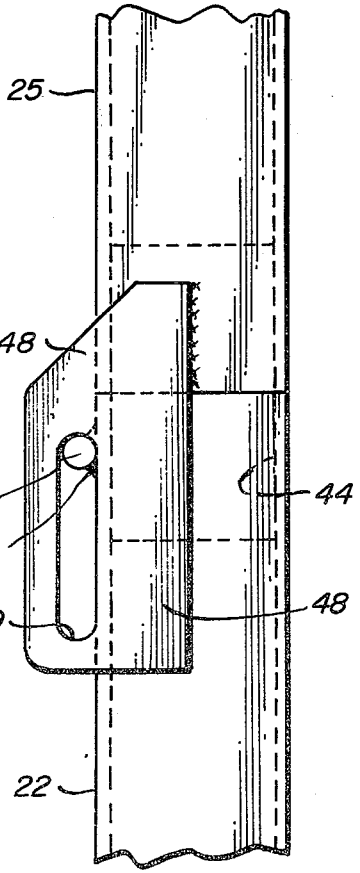
FIG. 7 is a side elevational view of the embodiment depicted in FIG. 6 of the drawings, and showing the details of the side plate and the relationship thereof with the pivot pin relative to the extension member and front support member respectively.
Figure 6:
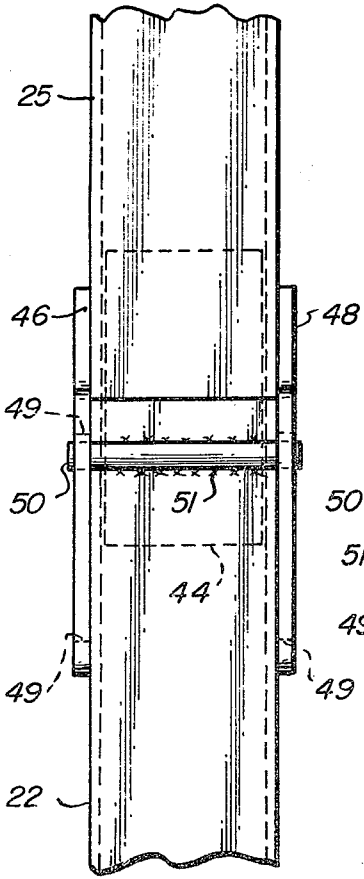
FIG. 6 is a front elevational view, partly in cross-section of the joint portion of a post assembly, showing a modified embodiment of the present invention, wherein the hinge assembly is formed by a horizontally mounted pin and the extension member includes a pair of side plates having vertical slots positioned therein.

In FIGS. 6 and 7 of the drawings, a modified embodiment of the invention is illustrated. With respect to the description of FIGS. 6 and 7 of the drawings, like numerals will be used to refer to like elements. The extension member 25 is similarly provided with a tubular collar 44, which is nestable within the confines of the front support member 22 at the top portion thereof. Each extension member 25 further includes a pair of side plates 46 and 48 respectively, the side plates 46 and 48 each being provided with a vertical slot 49. The front support member 22 carries a pivot pin 50 mounted horizontally thereon by means of a weldment 51. The horizontal pin 50 extends laterally for a short distance beyond the side edges of the front support member 22, a distance sufficient to ride within the vertical slots 49 of the opposed side plates 46 and 48 respectively.

It will be apparent from a view of FIGS. 6 and 7 of the drawings, that the extension member 25 is freely movable both pivotally and arcuately with respect to the front support member 22 in view of the fact that the side plates 46 and 48 permit the free movement of the extension member 25 as the pin 50 rides along the vertical slot 49. In this manner, the tubular collar 44 may be moved into or out of nesting relationship within the confines of the front support member 22 as the extension member is manually lifted out of or into engaged position. It is apparent that the concept of providing a hinged assembly for the extension member 25 is to provide a structure which permits the free pivotal and arcuate movement of the extension member 25 with respect to the front support member 22 in order to accommodate the insertion of the tubular collar 44 into nesting engagement within the confines of the front support member 22.

Finally, FIGS. 8 and 9 of the drawings illustrate still another embodiment of a hinged assembly to accomplish the objects and advantages of the present invention in that the hinged extension member is provided on a front support member. Once again, like numerals are used in connection with similar elements. Again, the extension member 25 is provided with a tubular collar 44 for nesting engagement within the upper confines of the front support member 22. The hinge assembly comprises a hook member, 55 having a U-shaped upper portion 56 pivotally mounted within the internal confines of the tubular collar 44 at a pivot point 58 such that the extension member 25 is freely movable about the pivot point 58 with respect to the hook member 55. The opposed end of the hook member 55 comprises an enlarged foot 59 which freely rides within the confines of the front support member 22. In addition, the front support member 22 is provided with a bolt forming a stop boss 61 which functions to limit the travel of the hook member 55 by engaging the enlarged foot 59 thereof.

It will be observed from a view of FIG. 9 of the drawings that the extension member 25 may be removed from the front support member 22 by manually withdrawing the tubular collar 44 from within the confines of the front support member 22. Once this movement has been achieved, the extension member 25 may then be arcuately and pivotally moved into the down or resting positon in view of the fact that the U-shaped portion 56 of the hook member 55 is freely pivotal about the pivotal point 58. In addition, the enlarged foot 59 of the hook member 55 will travel until the same meets the bolt/stop boss 61 provided in the front support member 22. At this point, the extension member 25 comes to rest in the down or disengaged position as more clearly shown in FIG. 9 of the drawings.

Insofar as the materials utilized in construction of the subject storage rack 10 is concerned, it is contemplated that a standard tubular steel may be employed. In point of fact, any gauge steel suitable for the purposes to which the storage rack is to be utilized may be employed. In addition, where it is contemplated that lighter materials are intended to be stored, it is further within the contemplation of the invention that the storage rack 10 may be formed of a plastic material, such as a hard plastic. It is therefore apparent that the particular materials of construction are not relevant with respect to the invention, except and only insofar as the materials have any relevance to the ability to form and fixedly secure the hinge assembly as prescribed above.

It will be apparent from the above description that the invention provides a storage rack which permits the reduction of the vertical height of the front portion of the rack, thereby to accommodate ease of loading and unloadng of materials from within the rack. This is especially useful where the vertical height involved in the warehouse space does not permit the insertion or removal of articles by elevating the same over the upper confines of the rack. In addition, this simplifies the procedure of loading and unloading where the equipment to be utilized has a limited vertical reach.

With respect to details of the invention, it is clear that the novel hinge assembly for accomplishing the stated objects and advantages permits both pivotal and arcuate movement of the extension member with respect to the front support member, while at the same time the extension member is provided with positive aligning and locking means for vertically aligning and locking the extension member into position with respect to the front support member. It will further be apparent that the invention is equally applicable where a plurality of extension members are interconnected by means of the novel hinge assembly as disclosed herein, such that the vertical height of the overall front support member may be increased as desired.

It is further apparent that the storage rack as described herein accomplishes all of the objects and advantages as set forth above, and that a storage rack is provided having a segmented and hinged post assembly permitting the free pivotal and arcuate movement of the extension member with respect to the front support member. In addition, the extension members is provided with a collar which accomplishes the vertical orientation and stabilization of the extension member when mounted in position and in vertical alignment with the front support member. It will therefore be appreciated that ease of front loading is accomplished by the present invention, thereby obviating the necessity for elevating articles to be stored or removed from storage over and above the upper confines of the storage racks. It is therefore submitted that these and other objects and advantages are provided by virtue of the present invention.

While there has been described what is at present considered to be the preferred embodiment of the invention, it is clear that various modifications may be made therein, and it is intended to cover in the appended claims all such modifications as fall within the true spirit and scope thereof.

What is claimed is:

1. A storage rack providing a vertically oriented storage well for storing articles therein, comprising in combination, a base, a plurality of support members mounted on said base and extending upwardly therefrom, said support members forming front and rear support means for articles stored within the rack, each of said support members provided with an extension member, hinge means for pivotally hinging each of said extension members to a corresponding support member and accommodating the pivotal movement of each of said extension members throughout an arc of 180° relative to said support members, said hinge means formed by a pivot pin horizontally mounted on each of said support members adjacent the upper portion thereof, each of said extension members including a pair of side plates mounted thereon in opposed relation adjacent the lower end thereof, each of said side plates being mounted horizontally offset with respect to each of said extension members, the offset portion of each of said side plates provided with a vertical slot therein, said pivot pin mounted on said front support member extending beyond the side edges of said corresponding support member for a short distance sufficient for constrained alignment with each of said slots provided in said side plates of said extension member, lock means for lockingly engaging each of said extension members in vertical alignment with said corresponding support members thereby to present an increase of vertical height for each of said support members thereby to increase the overall vertical storage well of said storage rack, whereby the hinge movement of said extension member with respect to said support member is accomplished by the movement of said pivot pin within the slotted confines of said slot and said side plate thereby to permit the arcuate pivotal movement of said extension member throughout an arc of 180° into vertical alignment with said support member.

2. The support rack as set forth in claim 1 above, wherein each of said support members and said extension members are tubular in configuration and said lock means is formed by a collar extending outwardly from the lower portion of said extension member having an overall diameter slightly smaller than the interior diameter of said tubular support member whereby said collar is insertable within said support member along the upper end thereof, such that said extension member may be pivotally moved into vertical alignment with said support member arcuately moving said extension member throughout an arc of 180° as said pivot pin rides within said slots of said side plates and vertical alignment and stability is achieved by inserting said collar within the upper confines of said support member until said extension member is firmly seated upon and within said support member.

3. The storage rack as set forth in claim 1 above, wherein each of said support members and extension members are tubular in configuration and said extension member includes a collar mounted on the lower end of said extension member extending outwardly therefrom, said collar having an overall diameter slightly less than the interior diameter of said support member and said hinge means comprises a hook member having the inner end thereof pivotally mounted adjacent the lower end of said collar and the opposed end thereof confined within the upper portion of said support member whwereby the arcuate pivot movement of said extension member with respect to said support member is accommodated by said hook member thereby to permit said collar on said extension member to be inserted within the upper confines of said support member until seated therein.

4. The storage rack as set forth in claim 3 above, wherein the outer opposed end of said hook member includes an enlarged foot confined within the upper confines of said support member and wherein said support member includes a stop boss mounted interiorly thereon, whereby said stop boss limits and confines the movement of said hook member by engaging the enlarged foot of said hook member when said extension member has been pivoted throughout 180° into the folded down posture.

5. A storage rack providing a vertically oriented storage well for storing articles therein, comprising in combination, a base, at least a pair of rear support tubular members mounted on said base and extending upwardly therefrom and forming a rear support means for articles stored within the rack, at least a pair of front support tubular members mounted on said base extending upwardly therefrom and positioned in opposed relation with respect to said rear support tubular members, said front support tubular members being vertically shorter than said rear support tubular members, each of said front support tubular members being provided with a tubular extension member, each of said extension members including a tubular collar extending outwardly from the lower portion thereof, each of said collars having an overall diameter slightly less than the interior diameter of said front support tubular member such that said collar is positionable within the confines of said front support tubular member adjacent the upper portion thereof, hinge means for pivotally hinging each of said extension members to a corresponding front support tubular member and accommodating the arcuate pivotal movement of said extension members throughout an arc of 180° relative to said front support tubular members, said hinge means formed by at least one hook member pivotally mounted on said collar of said extension member, along the interior portion thereof, and having the opposed end of said hook member riding within the open confines of said front support tubular member, said front support tubular member further includng a stop boss mounted thereon and interiorly thereof, such that the upward travel and movement of said opposed end of said hook member is limited by said stop boss, whereby each of said extension members may be freely pivoted throughout an arc of approximately 180° thereby to position each of said collars within the confines of said front support tubular members at the top ends thereof, to vertically axially align said extension members with said front support tubular members and lockingly engage the same in position, thereby to present an increased vertical height for each of said front support tubular members and increase the overall vertical storage well of said storage rack.

6. The storage rack as set forth in claim 5 above, wherein the opposed end of said hook member is provided with an enlarged foot which cooperates with said stop boss thereby to limit the path of movement of said hook member and thereby said extension member with respect to said front support tubular member when the same is pivoted into the open posture position.

* * * * *